United States Patent [19]

Mathew et al.

[11] 4,390,853

[45] Jun. 28, 1983

[54] MICROWAVE TRANSMISSION DEVICES COMPRISING GYROMAGNETIC MATERIAL HAVING SMOOTHLY VARYING SATURATION MAGNETIZATION

[75] Inventors: Moni G. Mathew; Thomas J. Weisz, both of Sunnyvale, Calif.

[73] Assignee: TRW Inc., Redondo Beach, Calif.

[21] Appl. No.: 292,202

[22] Filed: Aug. 12, 1981

Related U.S. Application Data

[63] Continuation of Ser. No. 139,815, Apr. 14, 1980, abandoned.

[51] Int. Cl.[3] ..... H01P 1/387; H01P 1/36; H01P 1/218

[52] U.S. Cl. ..... 333/1.1; 333/24.2; 333/204

[58] Field of Search ..... 333/1.1, 24.1, 24.2, 333/158, 161, 204

[56] References Cited

U.S. PATENT DOCUMENTS

| | | | |
|---|---|---|---|
| 3,295,074 | 12/1966 | Carr | 333/1.1 |
| 4,122,418 | 10/1978 | Nagao | 333/1.1 X |
| 4,186,357 | 1/1980 | Forterre et al. | 333/24.1 |

*Primary Examiner*—Paul L. Gensler
*Attorney, Agent, or Firm*—David E. Lovejoy

[57] ABSTRACT

A multi-port microwave device, such as an isolator or circulator, for transmission of electromagnetic energy in TEM and higher order modes non-reciprocally between parts. The device exhibits low insertion loss, high return loss (low VSWR) and high isolation and is operable over a 100 percent or more bandwidth. The microwave device includes a composite ferrite body between a circuit conductor and a ground plane. The composite ferrite body includes ferrite material having a saturation magnetization gradient for providing different frequency characteristics over the frequency pass band of the device.

22 Claims, 8 Drawing Figures

MICROWAVE TRANSMISSION DEVICES COMPRISING GYROMAGNETIC MATERIAL HAVING SMOOTHLY VARYING SATURATION MAGNETIZATION

This application is a continuation of application Ser. No. 139,815, filed Apr. 14, 1980 now abandoned.

BACKGROUND OF THE INVENTION

The present invention relates generally to microwave devices and more particularly to non-reciprocal microwave devices, such as circulators and isolators, having a large bandwidth.

Circulators and isolators are special classes of microwave devices which, like other transmission line devices, function to transfer or guide energy from one point to another. Such devices are normally classified on the basis of the field configurations called "modes" which they transmit. Devices are generally divided into groups, those capable of transmitting transverse electromagnetic (TEM) modes and those able to transmit higher-order modes. In a TEM mode, the electric field (E) and the magnetic field (H) are entirely transverse to the direction of propagation with no component of either E or H in the direction of transmission. The higher-order modes have components of E or H in the direction of transmission. The circulators and isolators of the present invention are particularly for both TEM mode transmission and higher-order mode transmission.

Circulators and isolators are well-known microwave devices for transferring energy between two or more ports. At least one input port receives electromagnetic energy and efficiently transfers that energy to an output port. Electromagnetic energy, if any, appearing as an input at the output port is not efficiently transferred, however, to the input port. Hence, the connection of electromagnetic energy among the various input and output ports of circulators and isolators is said to be non-reciprocal and the devices function to isolate input ports from output ports.

In a circulator, the direction of the magnetic field controls the direction of circulation of electromagnetic energy. For example, in a 3-port circulator, when the magnetic field is in a first direction normal to the plane of propagation, circulation among the ports numbered one, two and three is clockwise from one to two, from two to three, and from three to one and when the magnetic field is in the opposite direction, the circulation is from one to three, from three to two and from two to one.

When one of the ports of a 3-port circulator is terminated with the characteristic impedance of the device, the device functions as an isolator. With such a termination, the performance between the remaining two non-terminated ports is the same as for a 3-port circulator.

The performance of isolators and circulators is measured in terms of the insertion loss which is a measure of the efficiency of transmission from the input port to the output port. Another measure of performance is the return loss (or VSWR) which is a measure of how well the circulator is matched to the characteristic impedance. Also, the performance is measured in terms of the isolation of the input port from the output port. Another measure of the performance is the operating bandwidth over which the device may be employed for effective transfer of energy.

Good performance is achieved when the device has a low insertion loss, high return loss (low VSWR) and high isolation over a broad band of frequencies.

Since circulators and isolators and other microwave devices frequently find applications in airborne and satellite vehicles, small size and light weight are important objectives for these devices.

The basic structure and the theory of operation of circulators and isolators has been described in the literature for many years. For example, one well-known article is "Operation of the Ferrite Junction Circulator" by Fay and Comstock, *IEEE Transaction on Microwave Theory and Technique,* January, 1965, pages 15 through 27. In that article, a basic 3-port strip-line circulator is described. Such 3-port circulators are sometimes called Y-junction strip-line circulators. Other multi-port circulators are also described.

It is well known from that article and otherwise that strip-line circulators basically include a center conductor located equidistant between a first ground plane on one side and a second parallel ground plane on the other side. A layer of material, such as ferrite, exhibiting gyromagnetic properties, is located between the center conductor and one ground plane and similarly a second layer of the same ferrite material is located between the center conductor and the other ground plane. In a 3-port circulator, the center conductor is normally configured in the shape of a Y with three legs, each positioned in a flat plane projecting outwardly from a center point at angles of 120 degrees. The ferrite layers lie in a plane parallel to the planes formed by the center conductor and the two ground planes. A magnetic field is applied perpendicular to these planes through the ferrite layers and the center conductor. The magnetic field functions to bias the ferrites near but not at their saturation magnetization. These devices are known as below resonance devices.

In circulators of this well-known type, the bandwidth tends to be limited due to high insertion losses at the low frequency end of the pass band and tends to be limited due to higher-order moding (non TEM transmission) at the high frequency end of the pass band.

The bandwidth is defined to be the difference between the highest frequency of operation and the lowest frequency of operation at which acceptable levels of insertion loss without higher-order moding can be achieved. The bandwidth is given as follow:

$$BW = f_h - f_l \qquad \text{Eq.(1)}$$

where:

BW = bandwidth $f_h$ = highest frequency of pass band $f_l$ = lowest frequency of pass band In microwave devices, bandwidth is frequently measured in terms of the percent of the center frequency of the pass band as follows:

$$\%\ BW = (100)(f_h - f_l)/f_c \qquad \text{Eq.(2)}$$

where:

% BW = percent bandwidth relative to center frequency $f_h$ = high frequency of pass band $f_l$ = low frequency of pass band $f_c$ = center frequency of pass band = $(f_l + f_h)/2$ If the bandwidth is one octave, that is $f_h = 2f_l$, then the percent bandwidth is as follows:

$$\% \text{ BW} = 100(f_1)/(3f_1/2) = 200/3 = 66.66\% \quad \text{Eq. (3)}$$

From Eq.(3), it is clear that a one octave bandwidth is equal to 66.66 percent bandwidth. For example, a microwave device which operates over a bandwidth of 2 through 4 GHz($10^9$ Hz) operates over one octave since the higher frequency is twice the lower frequency. The percent bandwidth is determined by Eq.(3) where the center frequency is 3 and the bandwidth is 2 so that the percent bandwidth is $(\frac{2}{3})(100)$ or 66.66%. For a device in which the bandwidth extends over two octaves, for example from 2 through 8 GHz, the center frequency is 5, and the bandwidth is 6 and the percent bandwidth is (6/5)(100) or 120 percent.

Strip-line circulators have been available with acceptable insertion loss and isolation over one octave (66 percent bandwidth). There is a need for and it is an object of the present invention to provide improved devices having low insertion loss and high isolation up to 100 percent bandwidth or more and particularly to provide such devices which are compact and light weight.

It is still another object of this invention to provide a 100 percent or more bandwidth circulator and/or isolator that may be easily manufactured.

It is another object of this invention to provide a 100 percent or more bandwidth circulator and/or isolator for microwave transmission which will handle relatively high power of fifty watts or more.

It is an additional object of this invention to provide a device which functions equally well as a circulator or as an isolator.

SUMMARY OF THE INVENTION

The present invention is a multi-port microwave device, such as an isolator or circulator, for transmission of electromagnetic energy in TEM mode nonreciprocally between ports. The device exhibits low insertion loss and high isolation and is operable over a 100 percent or more bandwidth. The microwave device includes a ferrite body between a circuit conductor and a ground plane. The ferrite body is formed of ferrite material which exhibits a saturation magnetization gradient in the direction of propagation to provide broadband frequency characteristics.

In one preferred embodiment, a 3-port strip-line circulator is provided. The circulator includes a center conductor located in a plane which lies parallel to and equidistant between two parallel ground planes. The center conductor is formed by three legs which connect at a center point and extend outwardly from the center point at angles of 120 degrees. Both regions between the center conductor and the ground planes are filled with bodies each including an outer dielectric and an inner ferrite having a gradient of saturation magnetization. The ferrites are typically cylindrical where the gradient is established with the outer part having a lower saturation magnetization than the inner part. The saturation magnetization varies either continuously or with discrete steps along axes in the direction of propagation. The device includes magnetic means for magnetically biasing the ferrites. The magnetic means in one embodiment applies a magnetic field which is greater near the inner part.

Where discrete concentric ferrite cylinders are employed, the different ferrite cylinders are selected to have different saturation magnetizations, $4\pi M_s$, at different low ferrite frequencies, $f_{Fi}$, within the pass band of the device. In a device having a pass band from a low frequency, $f_l$, to a high frequency, $f_h$, a first one of the ferrite materials is selected to have a saturation magnetization determined for "i" equal to 1 as a function of a first ferrite frequency, $f_{F1}$, equal or nearly equal to the low frequency, $f_l$, of the band pass.

A second one of the discrete ferrite materials is selected for "i" equal to 2 to have a saturation magnetization determined as a function of a second ferrite frequency, $f_{F2}$, were $f_{F2}$ is selected to be greater than $f_{F1}$ and below the frequency at which higher-order moding occurs. Third and additional discrete ferrite materials are selected to have saturation magnetizations as a function of low ferrite frequencies, $f_{Fi}$, where "i" equals 3 and 4 where each of the frequencies $f_{Fi}$ is within the pass band of the device and is below a frequency at which higher-order moding occurs.

After selecting discrete ferrite materials with desired saturation magnetizations the relative permittivity of those ferrite materials is also known. The outer diameters $D_{Fi}$ of cylinders formed by the ferrite materials are selected to be equal to one-half the wavelength of the electromagnetic waves in the ferrites at each of their respective low ferrite frequencies, $f_{Fi}$. Specifically, for the "i" equal to 1, the diameter $D_{F1}$ of a first ferrite material is selected equal to one-half the wavelength at the low ferrite frequency $f_{F1}$ where $f_{F1}$ is typically equal to the low pass band frequency $f_l$. For "i" equal to 2, the diameter $D_{F2}$ of a second ferrite material is selected equal to one-half the wavelength at the low ferrite frequency $f_{F2}$ for the second ferrite material. The frequency $f_{F2}$ is selected to be greater than $f_{F1}$ and lower than the frequency at which higher-order moding occurs. The frequency $f_{F2}$ is generally less than $2f_{F1}$. When additional discrete ferrites are employed, their diameters similarly are selected to be one-half the wavelength at the successively higher low ferrite frequencies for the different ferrite materials. In this manner, a composite body of concentric ferrite cylinders exhibiting a saturation magnetization increasing from outer toward inner regions is formed. In such an embodiment the ferrite with a saturation magnetization gradient has discrete steps.

In other embodiments, ferrite material having a predetermined and continuous saturation magnetization gradient is employed. Ferrite materials having such gradients are formed, for example, by selectively mixing ferrite powders with variable concentrations and then firing the mixture.

The ground plane spacing, S, is selected to prevent higher-order moding up to some frequency such as the highest frequency $f_h$, of the pass band of the device. The ground plane spacing is uniform in one embodiment and has one or more steps in other embodiments to provide broad-band characteristics.

In accordance with the above summary, the present invention achieves the objective of providing improved microwave devices and ferrites therefor, such as 3-port circulators and isolators, which exhibit low insertion loss and high isolation, which can be 100 percent bandwidth or more and which can be compact and lightweight.

Additional objects and features of the present invention will appear from the following description in which the preferred embodiments of the invention have been set forth in detail in conjunction with the drawings.

DETAILED DESCRIPTION

Figure 1:
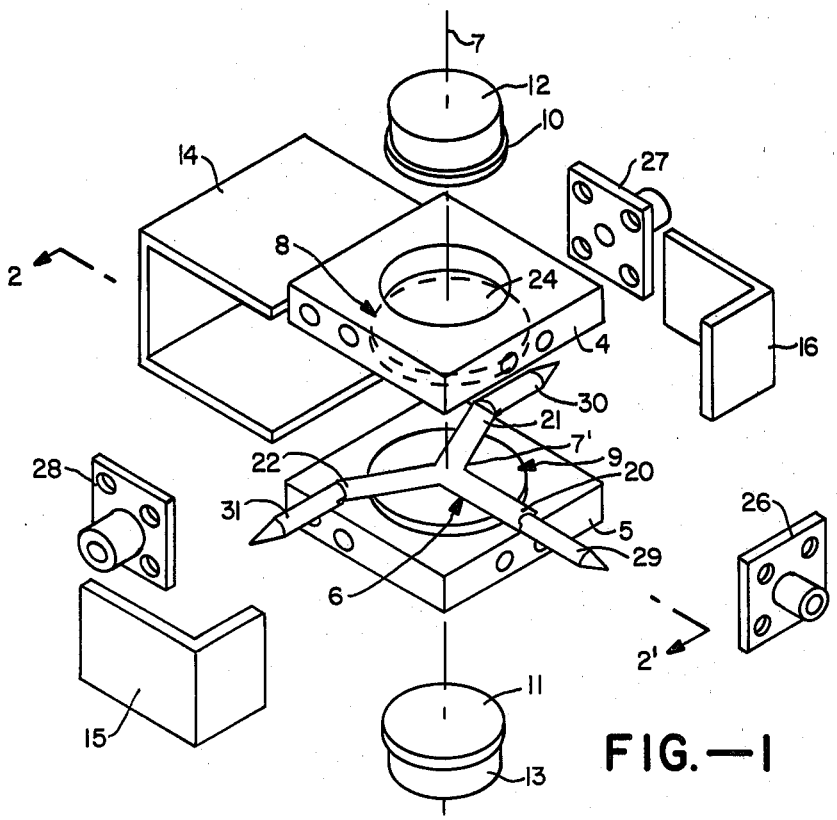
FIG. 1 is an exploded assembly view of a 3-port circulator employing a ferrite body having a saturation magnetization gradient for achieving broad-band operation in accordance with the present invention.

In FIG. 1, a non-reciprocal microwave device in accordance with the present invention is depicted in the form of a 3-port strip-line circulator. The circulator includes a first ground plane conductor 4 and a second ground plane conductor 5 which are both typically made from non-magnetic materials such as aluminum. The ground plane conductor 4 has an opening 24 for receiving a magnetic shunt 10, made from a magnetic material such as a cold-rolled steel, and a magnet 12. The ground plane conductor 5 is a mirror image of top ground plane conductor 4 and similarly has an opening 25 (see FIG. 2) for receiving a shunt 11 and a magnet 13. The shunts 10 and 11 and the magnets 12 and 13 establish a magnetic field in the region between the ground plane conductors 4 and 5 through the composite ferrite and dielectric bodies which form the layers 8 and 9 and which are located on either side of the center conductor 6. The center conductor 6 includes three legs 20, 21 and 22 which connect at a common point 7′ on the center axis 7. Each of the legs extends outwardly at angles of 120 degrees from each other in a center plane parallel to the ground planes formed by the ground plane conductors 4 and 5.

Each of the legs 20, 21 and 22 connects to one of the pins 29, 30 and 31, respectively, which constitute the center conductors of the three coaxial ports of the microwave device. The connectors 26, 27 and 28 form the outer conductors of the three coaxial ports. Each of the three connectors 26, 27 and 28 connects to the ground plane conductors 4 and 5. The pins 29, 30 and 31 protrude into the center of connectors 26, 27 and 28 without physical contact thereto. The pins 29, 30 and 31 and the connectors 26, 27 and 28 are all typically made of brass or berrillium copper.

When the microwave device of FIG. 1 is assembled, the end plates 15 and 16 abut the sides of the ground plane conductors 4 and 5 on the sides at which the pins 31 and 30 extend, respectively. The end plates 15 and 16 are typically made of non-magnetic materials such as aluminum. The top and bottom ground plane conductors 4 and 5 fit within the wraparound shield 14. The shield 14 is typically made of a magnetic material such as cold-rolled steel which forms a magnetic field path for the field established by the magnets 12 and 13. The magnetic field path is completed through the center conductor 6 and dielectric and ferrite layers 8 and 9 in a direction parallel to the vertical axis 7.

Figure 2:
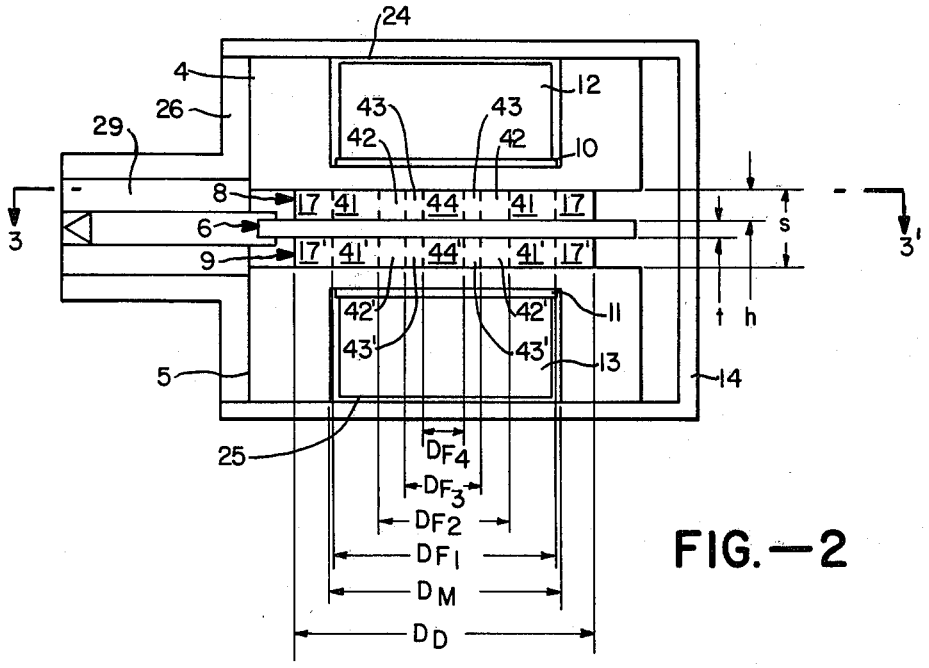
FIG. 2 is a sectional view of the device of FIG. 1 along the section line 2—2′ of FIG. 1 and assembled to be non-exploded.

In FIG. 2, a section view along the section line 2—2′ of FIG. 1 is shown as if FIG. 1 was not exploded. In FIG. 2, the ground plane conductors 4 and 5 are contained within the wraparound shield 14. The shunts 10 and 11 and magnets 12 and 13 are located within the openings 24 and 25 in the ground plane conductors 4 and 5. In this manner, a magnetic field with an axis parallel to the center axis 7 is established in a region between the ground plane conductors 4 and 5.

The separation distance, S, between the two ground plane conductors 4 and 5 is filled with the composite dielectric and ferrite body comprising layer 8, the center conductor 6, and the composite dielectric and ferrite body comprising layer 9. The thickness, h, of each of the layers 8 and 9 is the same. The center conductor 6 having a thickness, t, together with the cylinders 8 and 9 fill the gap between the ground plane conductors 4 and 5.

In FIG. 2, the dielectric and discrete ferrite materials forming the layers 8 and 9 are arrayed concentrically around the center axis 7. In layer 8, the dielectric cylinder 17 has an outer diameter $D_D$. The first discrete ferrite cylinder 41 is located concentrically within the dielectric cylinder 17 and is in contact therewith around its perimeter. The cylinder 41 has an outer diameter $D_{F1}$. Similarly, the second ferrite 42 is located concentrically within the first ferrite 41 and in contact with the ferrite 41. The ferrite 42 has an outer diameter $D_{F2}$. In a similar manner, ferrite cylinders 43 and 44 are concentrically arrayed with outer diameters $D_{F3}$ and $D_{F4}$, respectively. In FIG. 2, the layer 9 is the same as layer 8 and has corresponding concentric cylinders 17′, 41′, 42′, 43′ and 44′.

In FIG. 2, the composite bodies 8 and 9 each have a thickness, h. The center conductor 6 has a thickness t. The sum of h and t equals the ground plane spacing s.

Figure 3:
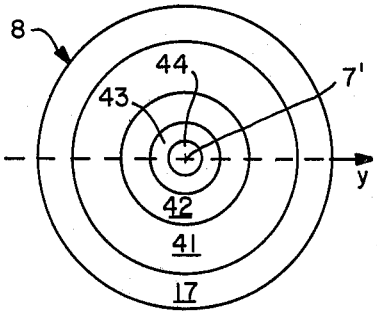
FIG. 3 is a top view of one composite dielectric and ferrite body with a saturation magnetization gradient employed in the FIG. 1 device where the ferrite includes a plurality of discrete ferrite cylinders.

In FIG. 3, a top view of the composite dielectric and ferrite layer 8 is shown taken along the section line 3—3′ in FIG. 2. The center conductor 6, the ground plane conductor 5, the shunt 11 and the magnet 13 are not shown in FIG. 3 for clarity. The dielectric cylinder 17 and the ferrite cylinders are arrayed concentrically around the center point 7′. A y axis extends through the cylinders at the center point 7′.

DETERMINATION OF PARAMETERS FOR FERRITE DEVICE STRUCTURES

In order to provide for a microwave device which is generally small and lightweight while still large enough to enable the mechanical dimensions to be easily obtainable, the diameter, $D_D$, of the dielectric cylinder 17 is suitably selected. As a general guideline, it is desirable that a number of impedance matching steps (changes in width) be made in each of the legs 20, 21 and 22 of the center conductor 6. Nominally, these impedance matching steps, if made for a narrow-band device, would be located at quarter wavelength increments along the legs 20, 21 and 22. Since several steps are generally required, the dielectric material is selected to have a radius large enough to permit such steps to be made and also is selected to be greater than the radius of the largest ferrite. The radius $R_D$ of the dielectric cylinder 17 is selected to be several times, generally two or more times, the quarter wavelength determined, for example, at the center frequency of the pass band of the device. The wavelength in the dielectric material is given as follows:

$$\lambda_D = C/[f_c(\epsilon_r)^{\frac{1}{2}}] \quad \text{Eq.(4)}$$

where:
$\lambda_D$ = wavelength of signal in dielectric material
C = velocity of light in free space = $3\times10^8$ m/sec = $11.81\times10^9$ inch/sec.
$f_c$ = center frequency = $(f_l+f_h)/2$
$\epsilon_r$ = relative permittivity of dielectric material In Eq.(4), a dielectric material with an $\epsilon_r$ of 16 is selected. For a device with a pass band from $f_l$ equal to 2 GHz to $f_h$ equal to 20 GHz, the center frequency $f_c$ is 11 GHz. Evaluating Eq.(4) using the above values determines the wavelength as approximately 0.134 inch (0.341 cm.). Accordingly, a quarter wavelength calculated in accordance with Eq.(4) is approximately 0.033 inch (0.081 cm.). In one particular embodiment, the radius, $R_D$, of the dielectric cylinder 17 is selected as approximately 0.50 inch (1.27 cm.) which is more than ten times the quarter wavelength of the center frequency.

Having thus specified the radius and relative permittivity of the dielectric material, the saturation magnetizations of the discrete ferrite materials are selected. The saturation magnetization is selected for a discrete ferrite cylinder in accordance with the following equation:

$$4\pi M_{si} = (f_{Fi})(p)/(2.8\times10^6) \quad \text{Eq.(5)}$$

where:
$4\pi M_{si}$ = saturation magnetization for the "$i^{th}$" ferrite
p = proportionality factor
$f_{Fi}$ = low ferrite frequency for the "$i^{th}$" ferrite In Eq.(5), the proportionality factor, p, is selected as less than unity so that operation occurs at less than saturation. The proportionality factor, p, in Eq.(5) is essentially the same as the p factor described in the above-referenced article "Operation of the Ferrite Junction Circulator" by Fay and Comstock at the point preceeding Eq.(35) therein.

In Eq.(5), for the particular example having a pass band from 2 GHz through 20 GHz, the low ferrite frequency $f_{Fi}$, for the first ferrite for "i" equal to 1 is denoted as $f_{F1}$ and is initially selected equal to 2 GHz. Using $f_{Fi}$ in Eq.(5) and some suitable value of p provides the saturation magnetization for the first ferrite as equal to approximately 550 gauss. One ferrite material having such a saturation also has a dielectric constant $\epsilon_r$ of 14.4.

Strip-line circulators using a single discrete ferrite structure are generally capable of a one octave frequency operating range without having higher-order moding. The ferrite materials are particularly useful for controlling TM higher-order moding due to the gyromagnetic properties of ferrites. Using this general guide, the first ferrite material 41 is likely to provide acceptable operation over the frequency range from 2 GHz to 4 GHz. In accordance with one embodiment of the present invention, the saturation magnetization of a second ferrite material 42 is selected employing Eq.(5) where for "i" equal to 2 the low ferrite frequency $f_{F2}$ is somewhat less than the one octave frequency of 4 GHz. The second low ferrite frequency $f_{F2}$ is typically selected at a frequency which is 80% to 90% of the one octave frequency. In one particular example, 87% of the 4 GHz frequency is selected, that is 3.48 GHz. Employing 3.48 GHz as the low ferrite frequency $f_{F2}$ in Eq.(5) produces, for one value of p, a saturation magnetization of 870 gauss. One particular ferrite having a saturation magnetization of 870 gauss has a dielectric constant $\epsilon_r$ of approximately 15.

The saturation magnetizations for the third and fourth discrete ferrite materials 43 and 44 are also determined using Eq.(5) with the low ferrite frequencies $f_{F3}$ and $f_{F4}$ equal to 6.96 and 13.92 GHz, respectively. In accordance with Eq.(5), corresponding saturation magnetizations of 1750 and 4000 gauss are selected, respectively, with relative permittivities of 12.2 and 12.3, respectively.

In preferred embodiments for circulators and isolators, the inner ferrite cylinders (effective for the higher frequencies) have higher saturation magnetizations than the outer ferrite cylinders (effective for the lower frequencies).

Having thus selected the appropriate ferrite materials for the ferrites 41, 42, 43 and 44, the diameter $D_{Fi}$ of each ferrite cylinder to be employed is now determined for "i" equal to 1, 2, 3 and 4 in accordance with the following equation:

$$D_{Fi} = C/[(2)(f_{Fi})(\epsilon_{ri})^{\frac{1}{2}}] \quad \text{Eq.(6)}$$

where:
$D_{Fi}$ = diameter of "$i^{th}$" ferrite cylinder
C = velocity of light in space
$f_{Fi}$ = low ferrite frequency for "$i^{th}$" ferrite
$\epsilon_{ri}$ = relative permittivity of "$i^{th}$" ferrite Eq.(6) is evaluated with "i" equal to 1 to determine a diameter, $D_{F1}$, for the first ferrite 41 using the relative permittivity $\epsilon_{ri}$ of 14.4 and a low ferrite frequency $f_{F1}$ equal to 2 GHz. Using these values, $D_{F1}$ is equal to 0.778 inch (1.976 cm.).

In a similar manner, Eq.(6) is evaluated for "i" equal to 2, 3 and 4 to determine the diameters, $D_{F2}$, $D_{F3}$ and $D_{F4}$ with the low ferrite frequencies $f_{F2}$, $f_{F3}$ and $f_{F4}$, respectively, of 3.48, 6.96 and 13.92 GHz, respectively, with $\epsilon_{r2}$, $\epsilon_{r3}$ and $\epsilon_{r4}$ equal to 15.4, 12.2 and 12.3, respectively. Using these values in Eq.(6) determines $D_{F2}$, $D_{F3}$, and $D_{F4}$ equal to 0.432 inch (1.097 cm.), 0.243 inch (0.617 cm.), and 0.121 inch (0.307 cm.).

Having thus determined the outer diameters of the ferrites, the thickness of the composite dielectric and ferrite bodies 8 and 9 is now determined. The thickness is determined by first determining the ground plane spacing, S, in accordance with variations of the following equation:

$$S = (\lambda_h)/[(2)(\epsilon_r)^{\frac{1}{2}}] \quad \text{Eq.(7)}$$

where:
S = ground plane spacing
$\lambda_h$ = wavelength ($\lambda_h = C/f_h$)
$\epsilon_r$ = relative permittivity of dielectric material
C = velocity of light in space
$f_h$ = high frequency of pass band The purpose of selecting a particular ground plane spacing is to inhibit higher-order moding up to at least the highest frequency, $f_h$, of the pass band of the microwave device. Ground plane spacing is particularly effective for inhibiting higher-order moding TE type electromagnetic energy. In the present example, $f_h$ is desired to be 20 GHz.

The above Eq.(7) has been proposed for microwave devices. For example, the article "How Much CW Power Can Strip-Lines Handle?" published by Paul Schiffres, *Microwave,* June 1966, proposed a constant 2 in his equation 1. However, constants other than 2 in Eq.(7) may be preferable.

Evaluating Eq.(7) using the relative permittivity of the dielectric material as equal to 16 and using the high frequency of the pass band as equal to 20 GHz, provides the ground plane spacing, S, as 0.0738 inch (0.187 cm.). After determination of the ground plane spacing, the inner conductor is selected with an arbitrary thickness of 0.016 inch (0.041 cm.) because brass stock of that thickness is readily available. Thereafter the thickness of each of the composite ferrite and dielectric layers is calculated using the following equation:

$$S=2h+t \qquad \text{Eq.(8)}$$

where:

S=ground plane spacing h=ferrite and dielectric composite body thickness t=inner conductor thickness Evaluating Eq.(8) using t as 0.016 inch (0.041 cm.) provides the ferrite and dielectric layer thickness, h, as equal to 0.0289 inch (0.073 cm.).

Having selected the dimension and characteristics of the dielectric and ferrite layer, the inner conductor 6 is now tailored for impedance matching.

In accordance with the above Eq.(4), the quarter wavelength steps are approximately 0.11 inch (0.254 cm.) for a narrow-band device at the 11 GHz center frequency. The rules applicable to narrow-band devices, however, are not directly applicable to the broad-band devices of the present invention. While a mathematical analysis of steps for impedance matching in a broad-band device can be undertaken, such analysis is complicated so that experimental techniques are usually preferred. In general, the determination of characteristic impedance and impedance matching in dielectric regions is well known from the published literature. Also, as a general guide, the impedance of the ferrite region is given by the following equation:

$$Z_F=(h\alpha Q_L)/[(0.74)\omega R^2\epsilon_o\epsilon_r] \qquad \text{Eq.(9)}$$

where:

$Z_F$=impedance of ferrite region h=ferrite thickness $\alpha$=center conductor function $Q_L$=loaded Q [proportional to saturation magnetization ($4\pi Ms$)]

$\omega=2\pi f$ where f is frequency $R_F$=outer radius of ferrite $\epsilon_o$=permittivity in space $\epsilon_r$=relative permittivity of ferrite From Eq.(9) it is apparent that as the radius of the ferrite decreases, the impedance increases. In order to compensate for a smaller radius, the relative permittivity of the ferrite may be increased, the thickness of the ferrite may be decreased or the loaded Q may be increased by increasing the saturation magnetization. Such variations, of course, involve design choices which affect many of the calculations in the above Eqs.(1) through (9).

As a general guide, characteristic impedance matching is carried out by having a plurality of impedance matching steps in the elongated members 20, 21 and 22 which are the legs of the center conductor 6. Some of the different steps in each of the elongated members are equal to respectively different quarter wavelengths or less of different frequencies within the pass band of the device. Less than quarter wavelength dimensions are particularly useful for fringe effects.

In FIGS. 1 and 2, the magnets 12 and 13 are each selected to have a magnetic field H such that the local magnetic field in the ferrite is below the lowest saturation magnetization of any of the ferrite materials of the device.

Figure 4:
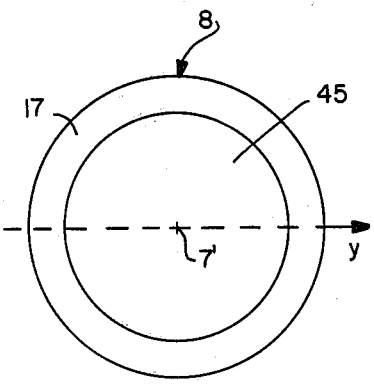
FIG. 4 is a top view of an alternative composite dielectric and ferrite body employed in the FIG. 1 device where the ferrite is a single cylinder with a continuous saturation magnetization gradient.

In FIG. 4, the composite body 8 includes an outer dielectric region 17 and an inner ferrite region 45. The ferrite region 45 has a saturation magnetization which is lowest around the perimeter of the region 45 and increases as the center point 7' is approached. In FIG. 4, the y axis is shown extending through the regions 17 and 45 and passes through the center point 7'. The composite body 8 of FIG. 4 includes a ferrite with a continuous gradient region 45 as distinguished from the FIG. 3 body which includes a number of discrete ferrite cylinders 41, 42, 43 and 44.

Figure 5:
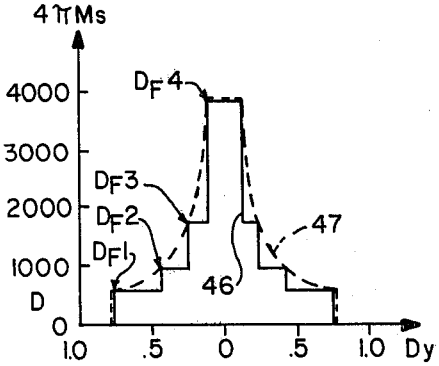
FIG. 5 is a graph depicting the ferrite saturation magnetization gradients for the FIG. 3 and FIG. 5 bodies.

In FIG. 5, the solid trace 46 is a representation of the saturation magnetization, $4\pi M_s$, as a function of the diameter, $D_y$, measured along the y axis for the composite body 8 of FIG. 3. Note that the gradient indicated by trace 46 includes discrete steps along the $D_y$ axis corresponding to the interfaces between the different ferrite cylinders 41, 42, 43 and 44 along the y axis in FIG. 3. In FIG. 5, the broken-line trace 47 represents the saturation magnetization as a function of the diameter, $D_y$, measured along the y axis for the composite body of FIG. 4. Both the traces 46 and 47 exhibit a gradient with the curve 46 having stepped changes while the curve 47 is continuous.

The parameters for establishing the trace 47 are determined using Eqs.(5) and (6) above in the following manner. Eq.(6) is solved for the frequency $f_{Fi}$ as follows:

$$f_{Fi}=C/[2D_{Fi}(\epsilon_{ri})^{\frac{1}{2}}] \qquad \text{Eq.(10)}$$

Eq.(10) is then substituted into Eq.(5) to form the following Eq.(11).

$$4\pi M_s=Cp/[2D_{Fi}(\epsilon_{ri})^{\frac{1}{2}}(2.8\times10^6)] \qquad \text{Eq.(11)}$$

In Eq.(11), a substitution of variables is performed to provide the saturation magnetization $(4\pi M_s)_y$ as a function of position where position is indicated by the variable $D_y$. The variable $D_y$ varies from $D_{FL}$ through $D_{FH}$ where the values of $D_{FL}$ and $D_{FH}$ are determined in accordance with Eq.(5) for the selected values of frequency. Such a substitution appears as the following Eq.(12.).

$$(4\pi M_s)_y=Cp/[2D_y(\epsilon_{ry})^{\frac{1}{2}}(2.8\times10^6)] \qquad \text{Eq.(12)}$$

where:

$$D_{FL}\geq D_y\geq D_{FH}$$

and where:

$(4\pi M_s)_y$=saturation magnetization as a function of y axis coordinate

C=velocity of light in space
p=proportionality factor
$D_y$=coordinate along y axis
$\epsilon_{ry}$=relative permittivity of ferrite material as a function of y axis coordinate
$D_{FL}$=diameter at lowest low ferrite frequency from Eq.(6)
$D_{FH}$=diameter at highest low ferrite frequency from Eq.(6)
FL=lowest low ferrite frequency
FH=highest low ferrite frequency Materials having a saturation magnetization gradient require special manufacture. Such materials can be manufactured by modifications of conventional methods of making ferrite materials. As a general guideline, standard techniques for making ferrites are described in the article "A Review of Ferrites for Microwave Applications", *Proceedings of the IEEE* Volume 63, Number 5, May, 1975 by Gerald F. Dionne, pages 777–789.

Modifications to the processes described in that article are possible to achieve ferrites having saturation magnetization gradients. For example, two or more ferrite powders are formed where each powder is of a type for producing ferrites having different saturation magnetizations. Thereafter, each of the different powders is mixed on a planar surface with a distribution such that a higher concentration of the higher saturation magnetization producing powder occurs toward the center of a cylindrical region. Similarly, a higher concentration of the lower saturation magnetization producing powder occurs toward the perimeter of the cylindrical region. Such a distribution can be achieved, for example, by concentric nozzels each spraying different powders onto the surface with the desired concentrations to obtain an appropriate mixture of ferrite powders. When the appropriate mixture is achieved, subsequent firing steps produce a ferrite body having a saturation magnetization gradient of the type shown by trace 47 in FIG. 5.

Of course, other methods of manufacturing ferrites with saturation magnetization gradients may also be employed. For example, during processing steps, a preferential magnetic field can be applied to a ferrite material whereby, due to a magnetic alignment of the molecular structure, a permanent gradient is introduced. A gradient may also be established by epitaxial growth of crystals using, at different stages of growth, solutions having different concentrations.

In one particular example of a ferrite device having a continuous gradient saturation magnetization the low ferrite frequency FL is selected as 2 GHz and the highest low ferrite frequency FH is selected as 13.92 GHz. These values correspond to the $F_{F1}$ and $f_{F4}$ low ferrite frequencies for the discrete device previously described. For the continuous device, the relative permittivity of the ferrite material $\epsilon_{ry}$ is selected to be a constant which does not vary as a function of the y axis coordinate. In one particular example, $\epsilon_{ry}$ is selected as 14. With the relative permittivity and the low ferrite frequencies thus selected, the diameter $D_{FL}$ at the lowest low ferrite frequency and the diameter $D_{FH}$ at the highest low ferrite frequency are each calculated in accordance with Eq.(6) to be 0.789 inch (2.004 cm.) and 0.113 inch (0.287 cm.), respectively.

The above values determine the range for the variable $D_y$ in Eq.(12). In FIG. 5, the saturation magnetization values $(4\pi M_s)_y$ determined in accordance with Eq.(12), when the proportionality factor is 0.77, is plotted as the broken line trace 46 as a function of the diameter $D_y$. FIG. 5 also shows as the solid line trace 46 discrete values of saturation magnetization previously calculated in connection with Eq.(5). It should be noted that in the continuous ferrite example of trace 47, $\epsilon_{ry}$ was selected as a constant while in the discrete example of trace 46, $\epsilon_{ri}$ varied as a function of the different ferrite cylinders, that is, varied as a function of the position on the y axis.

It is, of course, possible to have $\epsilon_{ry}$ vary as a function of the y axis coordinate. In such a case, the calculations in accordance with Eq.(12) necessarily result in different values for the saturation magnetization.

MAGNETIC FIELD GRADIENT

Figure 6:
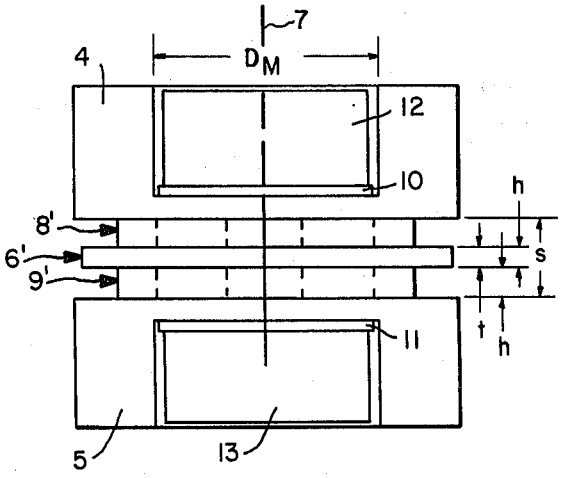
FIG. 6 is a sectional view of the device of FIG. 1 along the section line 2—2′ of FIG. 1 and assembled to be non-exploded and with composite bodies employing two discrete ferrite cylinders.

In FIG. 6 a section view like that of FIG. 2 is shown of the internal portion of a ferrite device. The shunts 10 and 11 and the magnets 12 and 13 are located within the openings 24 and 25 in the ground plane conductors 4 and 5. In this manner, a uniform magnetic field is applied along axes parallel to the center axis 7 and in a region between the ground plane conductors 4 and 5. That region includes, of course, the ferrites which are to be biased, in accordance with one embodiment, below saturation.

The separation distance, S, between the two ground plane conductors 4 and 5 is filled with a composite dielectric and ferrite body comprising the layer 8', the center conductor 6' and the composite dielectric and ferrite body comprising the layer 9'. The thickness, h, of each of the layers 8' and 9' is the same. The center conductor 6' has a thickness, t. While the structure of FIG. 6 applies a uniform magnetic field to the ferrites in the bodies 8' and 9', the local field established in those ferrites has a gradient as a function of the y axis because of the different composition of the ferrites. Specifically, the closer to the center axis 7', the higher the saturation magnetization and the higher the permeability of the ferrite. For this reason, the local field within the ferrite layers 8' and 9' tends to be stronger near the center axis 7 and tapers off to the lowest value in the dielectric region 17.

Figure 7:
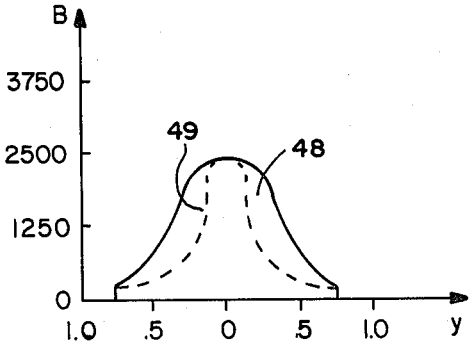
FIG. 7 is a waveform showing the local magnetic field in the ferrite devices of FIG. 6 and FIG. 8.

In FIG. 7, the solid trace 48 represents the local magnetization, B, within the ferrites of the FIG. 6 structure. In FIG. 7 it is apparent that the curve trace 48 may not in all cases adequately establish the magnetic field below the saturation levels for certain devices such as those of FIG. 3 or 4. The uniform ground plane structure of FIG. 6 can be employed, however, for many devices with appropriate selection of the ferrite materials and magnets. In one example, as indicated in the FIG. 6 device, the composite bodies 8' and 9' employ only two concentric ferrite cylinders. Such a structure has been found useful, for example, in providing a broad-bandwidth device having a pass band from 6 to 18 GHz.

Figure 8:
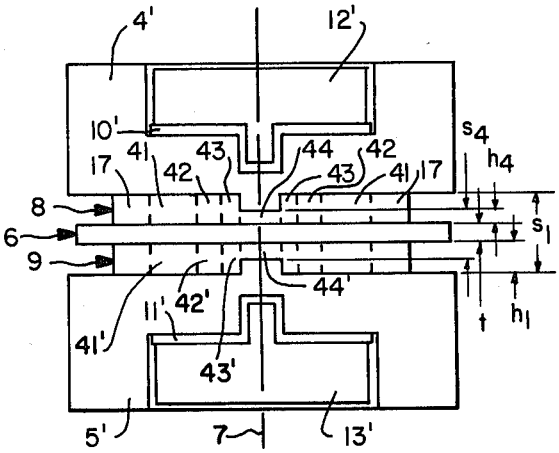
FIG. 8 is a sectional view, like FIG. 6, of an alternate embodiment of a device in which the ground plane spacing has a step and the ferrite cylinders are of different thicknesses.

Referring to FIG. 8, a sectional view similar to FIG. 2 is shown in which two different ground plane spacings, namely, S1 and S4, are employed. Also, the ground plane conductors 4' and 5' have a variable wall thickness so as to establish a magnetic field which has a larger gradient than in the FIG. 6 embodiment. The distance between the magnets 12' and 13' is less in the region of the center axis 7 juxtaposed ferrite cylinders 44 and 44' and is much greater in the region juxtaposed ferrite cylinders 41, 42, 43 and 41', 42' and 43'. The magnets 12' and 13' and the shunts 10' and 11' have steps which cause the local magnetic field, B, to be much greater in the center region where the ferrite material with the highest saturation magnetization is located while at the same time causes the field to be lower where the ferrite materials with lower saturation magnetizations are located. In this manner, the local magnetic field is established at the desired strength below the saturation level for the ferrite devices of FIGS. 3 and 4.

Referring to FIG. 7, the local magnetic field established in the ferrite composite bodies 8 and 9 in FIG. 8 is shown as the broken line trace 49 in FIG. 7. By comparing the trace 49 with the traces 46 and 47 in FIG. 5, it is readily seen that the local magnetic field biases the ferrites below the saturation levels in a manner that is desired in accordance with the present invention.

In FIG. 8, the ground plane spacing in the cylinder region containing the inner most ferrite 44 in both the layers 8 and 9 has a dimension S4. The dimension S4 is determined in accordance with Eq.(7) using $\epsilon_r$ for the dielectric material and using the high frequency of the pass band $f_h$ which in one particular example is 20 GHz. The remainder of the ground plane spacing is a dimension, S1, which is also determined in accordance with Eq.(7) using a frequency, $f_h$, equal to some other value such as 6 GHz.

FURTHER AND OTHER EMBODIMENTS

While the present invention has been described in detail in connection with a composite dielectric and ferrite body formed of either concentric cylinders or of a continuous ferrite, other ferrite structures can be employed without departing from the spirit and scope of the invention. In general, for a 3-port strip-line circulator, triangular or other shape materials may be employed. In such a case, the ferrite diameter dimensions may be calculated employing the inscribed cylinder which fits within the shape of the ferrite solid structure employed. If irregular shaped structures are employed, then the calculations become more difficult but can be made directly or can be determined by experimentation without departing from the spirit and scope of the present invention. The present invention contemplates the use of ferrite materials having saturation magnetization gradient (both discrete and continuous) to provide different frequency characteristics over the pass band of a non-reciprocal microwave device.

While the present invention has been described in terms of strip-line circulators, the principles of the present invention apply to microstrip, waveguide and other non-reciprocal devices for TEM and higher-order mode transmission as will be apparent to those skilled in the art.

While the invention has been described in connection with below resonance operation, the invention also may be implemented for above resonance operation. In such a case, the p factor in Eq.(5) and Eq.(12) is greater than unity. Also, for above resonance operation, the magnets are selected to provide a local magnetic field in the ferrites greater than the highest saturation magnetization for any of the ferrites. Also, the diameters of Eq.(6) are reduced. Frequently, for above resonance devices, triangular-shaped ferrites are employed where the diameter is for the inscribed cylinder with a diameter less than that given by Eq.(6). Two or more concentric ferrite triangular-shaped solids or other solid structures exhibiting a saturation magnetization gradient are employed where each ferrite has different frequency characteristics.

Although an increasing saturation magnetization gradient has been previously described where the saturation magnetization increases from the outer diameter toward the center, a decreasing gradient is also employed where the saturation magnetization decreases from the outer diameter toward the center. Similar, combinations of increasing and decreasing gradients are employed. The use of decreasing saturation magnetization gradients or combinations of increasing and decreasing gradients is particularly useful for forming a frequency rejection band within the frequency pass band of a device. Such a device functions as a filter and filters the rejection band.

In an embodiment where a continuous saturation magnetization gradient is employed (FIG. 4 ferrite) together with a uniformly applied magnetic field (FIG. 6 ground plane structure with FIG. 4 ferrite), the impedance in the ferrite varies continuously thereby forming a phase shifter device. In such a phase shifter, the phase of the output signal is shifted relative to the phase of the input signal. The amount of such phase shift is proportional to and varies as a function of frequency.

Although the specific embodiments previously described in the present application employ permanent magnets, the present invention also embodies electromagnets. Such electromagnets typically may be latched by an appropriate electric current to cause the magnetic field to be in either of two directions. In one direction of the magnetic field for a circulator device, the circulation is clockwise and in the other direction, the circulation is counter-clockwise. For a phase shifter device with one direction of magnetic field, a field in the opposite direction produces an attenuator.

Two or more circulators, isolators or other non-reciprocal devices in accordance with the present invention are cascaded to increase isolation without reducing the return loss.

While the invention has been particularly shown and described with reference to the preferred embodiments thereof, it will be understood by those skilled in the art that those changes in form and details may be made therein without departing from the spirit and the scope of the invention.

What is claimed is:

1. A microwave transmission device comprising, a first conductor disposed in a first plane, a second conductor disposed in a second plane in parallel relation and spaced from said first conductor for transmitting electromagnetic energy in a single TEM mode with other modes suppressed, a first body including a first gyromagnetic material adapted to be magnetized by a magnetic field and disposed between said first and second conductors, said body having a smoothly varying saturation magnetization in a direction parallel to said first plane for providing broad bandwidth operation for said device, said saturation magnetization varying as a function of position in a plane parallel to said first plane.

2. The device of claim 1 wherein said body of gyromagnetic material includes an outer region, a middle region, and an inner region and wherein said saturation magnetization decreases from said outer region to said middle region and wherein said saturation magnetization increases from said middle region to said inner region whereby said middle region provides a rejection band of frequencies within said pass band.

3. The device of claim 1 including a third conductor disposed in a third plane in parallel relation and spaced from said first and second conductors such that said second conductor is between said first and third conductors and including a second body including a second gyromagnetic material adapted to be magnetized by a magnetic field and disposed between said second and third conductors, said second body having a smoothly varying saturation magnetization in said direction providing broad bandwidth operation for said device.

4. The device of claim 3 wherein said first and second gyromagnetic materials are each ferrite cylinders having an outer diameter equal to one-half the wavelength of electromagnetic energy transmitted at a low ferrite frequency within the frequency pass band of said device.

5. The device of claim 4 wherein said first and second gyromagnetic materials each have an increasing gradient whereby the saturation magnetization is lower near said outer diameter and increases toward the center of said cylinders.

6. The device of claim 4 wherein said first and second gyromagnetic materials each have a decreasing gradient whereby the saturation magnetization is higher near said outer diameter and decreases toward the center of said cylinders.

7. The device of claim 4 wherein said outer diameter of said ferrite cylinders is equal to $$D_{FL}=C/[(2)(f_{FL})(\epsilon_{rL})^{\frac{1}{2}}]$$

where:

$D_{FL}$=outer diameter of ferrite cylinder

C=speed of light in space $f_{FL}$=low ferrite frequency for lowest frequency of pass band $\epsilon_{rL}$=relative permittivity of ferrite cylinder at the outer diameter.

8. The device of claim 4 wherein said first body and said second body include first and second dielectric cylinders, respectively, where said first and second ferrite cylinders are concentrically disposed within said first and second dielectric cylinders, respectively.

9. The device of claim 8 wherein said first body and said second body fill the space between said first and second conductors and between said second and third conductors, respectively, and wherein the spacing between said first and third conductors is the ground plane spacing defined by:

$$S=(\lambda_h)/[(2)(\epsilon_r)^{\frac{1}{2}}]$$

where:

S=ground plane spacing $\lambda_h$=wavelength ($\lambda_h=C/f_h$)

$\epsilon_r$=relative permittivity of dielectric material

C=velocity of light in space $f_h$=highest frequency of pass band.

10. A microwave transmission device comprising, first and second ground plane members disposed in spaced parallel relation to each other, conductive planar means disposed between and in parallel relation with and spaced from said ground plane members, said conductive planar means having a central portion and a plurality of elongated members extending therefrom for transmitting TEM-mode energy and for suppressing transmission of other modes of energy, at least first and second bodies of gyromagnetic material adapted to be magnetized by a magnetic field, said bodies disposed on opposite sides of at least said central portion of said planar means, each of said bodies including gyromagnetic material having a saturation magnetization gradient providing frequency characteristics for broad bandwidth operation of said device where said gyromagnetic material includes a ferrite material exhibiting a smoothly varying saturation magnetization as a function of position in a plane parallel to said first plane.

11. The device of claim 10 wherein said gyromagnetic material includes first and second ferrite cylinders, one for each of said first and second bodies, respectively, each having an outer diameter equal to one-half the wavelength of electromagnetic energy transmitted at a low ferrite frequency within the frequency pass band of said device.

12. The device of claim 11 wherein said outer diameter of said ferrite cylinders is equal to $$D_{FL}=C/[(2)(f_{FL})(\epsilon_{rL})^{\frac{1}{2}}]$$

where:

$D_{FL}$=outer diameter of ferrite cylinder

C=speed of light in space $f_{FL}$=low ferrite frequency for lowest frequency of pass band $\epsilon_{rL}$=relative permittivity of ferrite cylinder at the outer diameter.

13. The device of claim 11 wherein said first body and said second body include first and second dielectric cylinders, respectively, where said first and second ferrite cylinders are concentrically disposed within said first and second dielectric cylinders, respectively.

14. The device of claim 13 wherein said first body and said second body fill the space between said first ground plane members and said conductive planar means and between said conductive planar means and said second ground plane members, respectively, and wherein the spacing between said first and second ground plane members is the ground plane spacing defined by:

$$S=(\lambda_h)/[(2)(\epsilon_r)^{\frac{1}{2}}]$$

where:

S=ground plane spacing $\lambda_h$=wavelength ($\lambda_h=C/f_h$)

$\epsilon_r$=relative permittivity of dielectric material

C=velocity of light in space $f_h$=highest frequency of pass band.

15. The device of claim 11 wherein for each of said ferrite cylinders the saturation magnetization gradient is formed with the saturation magnetization lower in the region near said outer diameter and higher in the region near the center of said cylinders.

16. The device of claim 11 wherein said saturation magnetization is determined along a y axis passing through the center of said cylinders and parallel to said plane by:

$$(4\pi M_s)_y=Cp/[2D_y(\epsilon_{ry})^{\frac{1}{2}}(2.8\times10^6)] \quad \text{Eq. (12)}$$

where:

$$D_{FL}\geqq D_y\geqq D_{FH}$$

and where:

$(4\pi M_s)_y$=saturation magnetization as a function of y axis coordinate

C=velocity of light in space p=proportionality factor $D_y$=coordinate along y axis $\epsilon_{ry}$=relative permittivity of ferrite material as a function of y axis coordinate $D_{FL}$=diameter at lowest low ferrite frequency $D_{FH}$=diameter at highest low ferrite frequency FL=lowest low ferrite frequency FH=highest low ferrite frequency.

17. The device of claim 11 wherein said first and second ferrite cylinders are concentrically located within respective dielectric cylinders and wherein the spacing at one location between said first and second ground plane members is defined by:

$$S=(\lambda_h)/[(2)(\epsilon_r)^{\frac{1}{2}}]$$

where:

S=ground plane spacing $\lambda_h$=wavelength ($\lambda_h=C/f_h$)

$\epsilon_r$=relative permittivity of dielectric material

C=velocity of light in space $f_h$=highest frequency of pass band.

18. A 3-port circulator device operative over a broad pass band of frequencies for non-reciprocally transferring microwave energy in TEM mode among three ports, each of said ports having an outer conductor and a coaxial inner conductor, said device comprising, first and second conductive ground plane members disposed in spaced parallel relation to each other and spaced apart in one region by a ground plane spacing S for inhibiting higher-order TE mode transmission within said pass band, each of said conductive ground plane members connected to the outer conductor of each of said ports, a center conductor disposed in a center plane between and in parallel relation with and equally spaced from said ground plane members, said center conductor having a central portion and three legs extending along radial axes at equal radial angles from said central portion, each one of said legs connected to a different coaxial inner conductor for a different one of said ports for TEM mode transmission within said pass band, first and second composite bodies, said first composite body disposed between said first ground plane member and said center conductor, said second composite body disposed between said second ground plane member and said center conductor, each of said composite bodies including, a ferrite cylinder having a smoothly varying saturation magnetization where saturation magnetization near the outer diameter is less than the saturation magnetization near the center of the cylinder, said ferrite cylinder disposed concentrically within a dielectric cylinder, said ferrite cylinder having an outer diameter equal to one-half the wavelength of electromagnetic energy transmitted at a low ferrite frequency within the pass band of said device, said composite bodies functioning to inhibit higher-order TM mode transmission within said pass band, magnetic field means for establishing a magnetic field in a direction normal to said center plane to bias said ferrite cylinders below saturation.

19. The device of claim 18 wherein said saturation magnetization is determined along a y axis passing through the center of said cylinders and parallel to said plane by:

$$(4\pi M_s)_y=Cp/[2D_y(\epsilon_{ry})^{\frac{1}{2}}(2.8\times10^6)]$$

where:

$$D_{FL}\geqq D_y\geqq D_{FH}$$

and where:

$(4\pi M_s)_y$=saturation magnetization as a function of y axis coordinate

C=velocity of light in space p=proportionality factor $D_y$=coordinate along y axis $\epsilon_{ry}$=relative permittivity of ferrite material as a function of y axis coordinate $D_{FL}$=diameter at lowest low ferrite frequency $D_{FH}$=diameter at highest low ferrite frequency FL=lowest low ferrite frequency FH=highest low ferrite frequency..

20. The device of claim 18 wherein the groundplane spacing is defined by:

$$S=(\lambda_h)/[(2)(\epsilon_r)^{\frac{1}{2}}]$$

where:

S=ground plane spacing $\lambda_h$=wavelength ($\lambda_h=C/f_h$)

$\epsilon_r$=relative permittivity of dielectric material

C=velocity of light in space $f_h$=highest frequency of pass band.

21. The device of claim 18 wherein said magnetic field means includes one or more permanent magnets.

22. The device of claim 18 where one of said three ports is terminated in the characteristic impedance of said device whereby said circulator is an isolator having a broad bandwidth.

* * * * *